US010504675B2

(12) United States Patent
Gutmann et al.

(10) Patent No.: US 10,504,675 B2
(45) Date of Patent: Dec. 10, 2019

(54) CONTACT SPRING AND CRADLE FOR AN ELECTRICAL SWITCHING ELEMENT AND SAME

(71) Applicant: Tyco Electronics Austria GmbH, Vienna (AT)

(72) Inventors: Markus Gutmann, Brand (AT); Rudolf Mikl, Maria Ellend (AT)

(73) Assignee: Tyco Electronics Austria GmbH, Vienna (AT)

( * ) Notice: Subject to any disclaimer, the term of this patent is extended or adjusted under 35 U.S.C. 154(b) by 260 days.

(21) Appl. No.: 15/483,314

(22) Filed: Apr. 10, 2017

(65) Prior Publication Data

US 2017/0213679 A1 Jul. 27, 2017

Related U.S. Application Data

(63) Continuation of application No. PCT/EP2015/073564, filed on Oct. 12, 2015.

(30) Foreign Application Priority Data

Oct. 13, 2014 (DE) ..... 10 2014 220 700

(51) Int. Cl.

| | |
|---|---|
| ***H01H 50/56*** | (2006.01) |
| ***H01H 50/58*** | (2006.01) |
| ***H01H 50/54*** | (2006.01) |
| ***H01H 50/64*** | (2006.01) |

(52) U.S. Cl.

CPC ..... *H01H 50/56* (2013.01); *H01H 50/54* (2013.01); *H01H 50/58* (2013.01); *H01H 50/642* (2013.01)

(58) Field of Classification Search

CPC ..... H01H 50/54; H01H 50/56; H01H 50/58

See application file for complete search history.

(56) References Cited

U.S. PATENT DOCUMENTS

| | | | | |
|---|---|---|---|---|
| 2,731,527 | A * | 1/1956 | Marsh | H01H 1/50 200/288 |
| 6,816,044 | B2 | 11/2004 | Mader et al. | |
| 7,616,082 | B2 * | 11/2009 | Katou | H01H 50/642 335/151 |

FOREIGN PATENT DOCUMENTS

| | | | |
|---|---|---|---|
| CN | 1377053 | A | 10/2002 |
| EP | 1244127 | A2 | 9/2002 |
| EP | 1420428 | A1 | 5/2004 |
| EP | 1681699 | A1 | 7/2006 |
| EP | 2131377 | A1 | 12/2009 |
| JP | 2011014402 | A | 1/2011 |

OTHER PUBLICATIONS

International Preliminary Report on Patentability, dated Apr. 18, 2017, 9 pages.

Chinese First Office Action and English translation, dated Jun. 4, 2018, 14 pages.

International Search Report and Written Opinion, dated Dec. 11, 2015, 12 pages.

(Continued)

*Primary Examiner* — Ramon M Barrera

(74) *Attorney, Agent, or Firm* — Barley Snyder

(57) ABSTRACT

A contact spring for a cradle relay of an electrical switch comprises a switching leg and a hook extending from the switching leg. The switching leg has a contact. The hook has a first tongue bent back toward the switching leg.

17 Claims, 4 Drawing Sheets

(56) References Cited

OTHER PUBLICATIONS

Abstract of EP2131377, dated Dec. 9, 2009, 1 page.
Abstract of JP2011014402A, dated Jan. 20, 2011.
Notice of Reasons for Refusal, English translation, 4 pages, dated Mar. 27, 2018.

* cited by examiner

CONTACT SPRING AND CRADLE FOR AN ELECTRICAL SWITCHING ELEMENT AND SAME

CROSS-REFERENCE TO RELATED APPLICATIONS

This application is a continuation of PCT International Application No. PCT/EP2015/073564, filed on Oct. 12, 2015, which claims priority under 35 U.S.C. § 119 to German Patent Application No. 102014220700.2, filed on Oct. 13, 2014.

FIELD OF THE INVENTION

The present invention relates to a contact spring, and more particularly, to a contact spring and cradle for a cradle relay of an electrical switch.

BACKGROUND

Cradles of known cradle relays are at least partly insulating and connect a relay armature and an electrical contact spring of an electrical switch. The cradle transmits the armature movement to the contact spring.

Known contact springs generally have hook-shaped attaching mechanisms, frequently formed as projections extending away from the contact spring, in order to connect to the cradle. During mounting, a slot-shaped aperture of the cradle is placed onto the hook-shaped attaching mechanism. To thread the hook-shaped attaching mechanisms of the contact springs, generally already arranged in a housing, into the cradle's aperture, the cradle must be pivoted so that the attaching mechanisms can penetrate into the apertures. This type of mounting is, however, complex and makes it necessary for there to be sufficient space in a housing of the electrical switch for the pivoting movement of the cradle. This can impede a compact design of an electrical switch.

SUMMARY

An object of the invention, among others, is to provide a contact spring for a cradle relay which permits simple mounting of the components in a compact space. A contact spring according to the invention comprises a switching leg and a hook extending from the switching leg. The switching leg has a contact. The hook has a first tongue bent back toward the switching leg.

BRIEF DESCRIPTION OF THE DRAWINGS

The invention will now be described by way of example with reference to the accompanying figures, of which.

DETAILED DESCRIPTION OF THE EMBODIMENT(S)

Figure 1A:
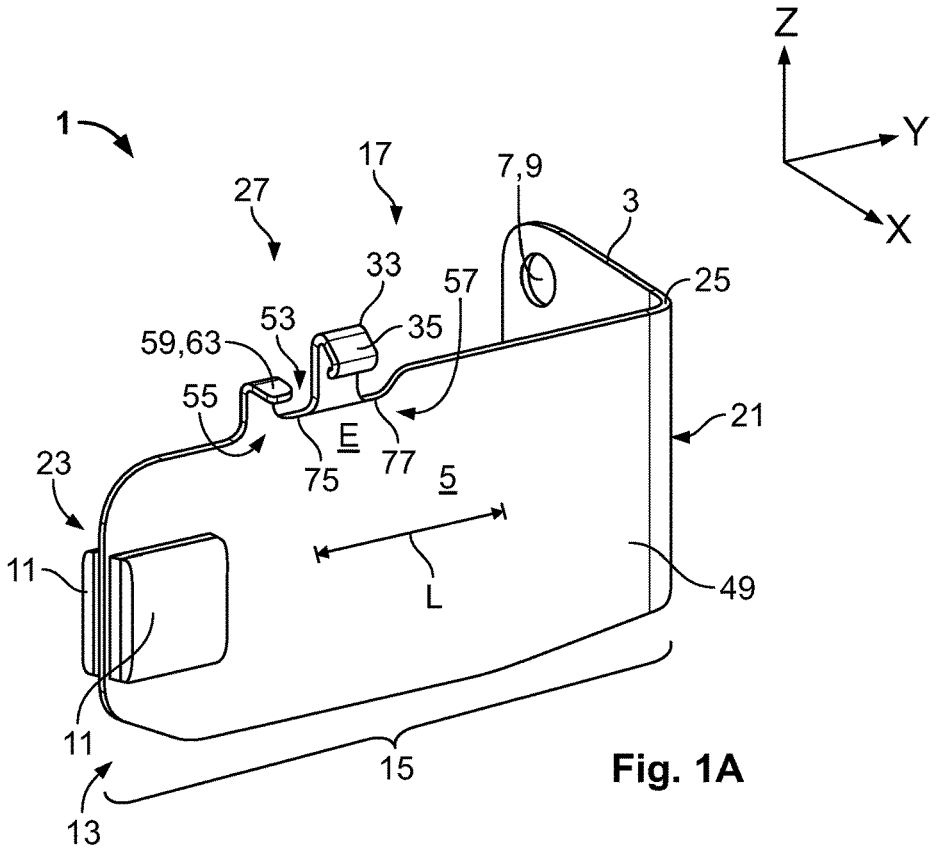
FIG. 1A is a perspective view of a contact spring according to the invention.

Exemplary embodiments of the present invention will be described hereinafter in detail with reference to the drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 1B:
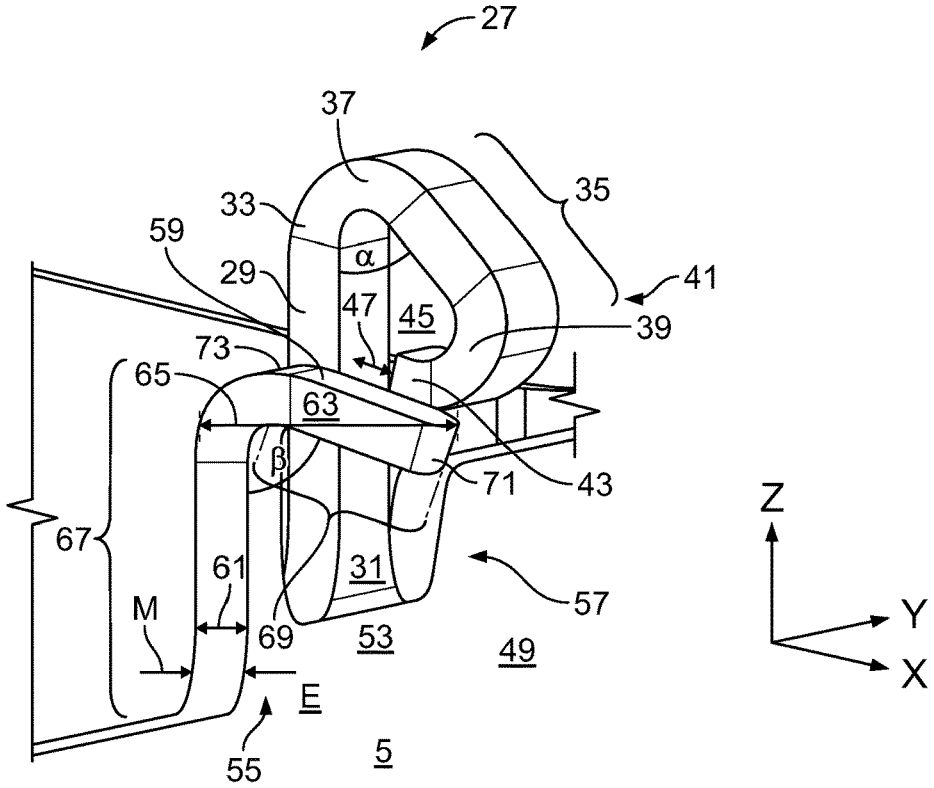
FIG. 1B is an enlarged view of a hook of the contact spring of FIG. 1A.

A contact spring 1 according to the invention is shown in FIGS. 1A and 1B. The contact spring 1, as shown in FIG. 1A, is bent at a right angle, such that it has an attaching leg 3 and a switching leg 5. In other embodiments, the contact spring 1 may have an elongated shape consisting of a continuous elongated body rather than being bent at a right angle.

The attaching leg 3 has an attaching apparatus 7 for attaching the contact spring 1 to a housing of an electrical switch. In the shown embodiment, the attaching apparatus 7 is a plurality of attaching passageways 9.

The switching leg 5, as shown in FIG. 1A, has an overall elongated shape extending along a longitudinal direction L. The longitudinal direction L runs parallel to a Y-axis shown in FIG. 1A. A pair of contacts 11 is disposed on the switching leg 5. The contacts 11 are disposed on an end 13 of the contact spring 1 opposite the attaching leg 3. In other embodiments, the contact spring 1 can have more than two or only one contact 11.

The switching leg 5 forms an elongated subcomponent 15. The elongated subcomponent 15 extends along the longitudinal direction L. The elongate subcomponent 15 has two long sides 17, 19 and two short sides 21, 23. The short side 21 is formed by a bend 25 between the attaching leg 3 and the switching leg 5. The contacts 11 are disposed flush with the opposite short side 23.

A hook 27 is disposed on the long side 17 as shown in FIG. 1A. The hook 27, as shown in FIG. 1B, projects from the long side 17 upwards in a Z-direction and forwards in an X-direction. A shaft 29 of the hook 27 extending upwards from the long side 17. The shaft 29 is widened in the longitudinal direction L at a lower end 31. The shaft 29 forms a starting section of a first tongue 33, which is integrally formed with the switching leg 5 and contact spring 1. The first tongue 33 is formed into the hook 27; the first tongue 33 has a bent-back section 35 which forms the forwardly projecting part of the hook 27, as shown in FIG. 1B.

The bent-back section 35 is bent, as shown in FIG. 1B, such that an angle $\alpha$ between the shaft 29 and the bent-back section 35 is 30°-50°. The angle $\alpha$ in the shown embodiment is 40°±5°. The bent-back section 35 is thus bent by more than 90° from a plane E of the contact spring 1 in the region of the hook 27. At an angle $\alpha$ of 40°±5°, the bent-back section 35 is thus bent 140°±5° out of the plane E which runs parallel to the Z-direction. A transition region between the shaft 29 and the bent-back section 35 forms a first bend 37.

The first tongue 33, as shown in FIG. 1B, has a second bend 39 formed at a lower end 41 of the bent-back section 35. Through the second bend 39, there is formed an end section 43 which is bent back on the first tongue 33 itself. The end section 43 extends at least partially upwards. The end section 43 projects into an intermediate space 45 between the shaft 29 and the bent-back section 35. The hook 27 consequently has no sharp edges which can lead to tilting or damage when the hook 27 is introduced into a cradle. The end section 43 is spaced apart from the switching leg 5 of the contact spring 1 and the shaft 29. A distance 47 between the end section 43 and the switching leg 5 of the contact spring 1 is greater than a material thickness M of the contact spring 1. The bent-back section 35, together with the end section 43, can be deflected towards the shaft 29 by the distance 47 since a material 49 of the contact spring 1 is generally elastic. The hook 27 is therefore an elastically deformable snap-fit hook 27.

A plurality of shoulders 55, 57, as shown in FIG. 1B, are disposed at a base 53 of the hook 27. A contact-side shoulder 55 has a support surface 59. The support surface 59 is formed by a bent second tongue 63. An overall width 65 of the second tongue 63 in a direction 61 of the material thickness M is greater than the material thickness M. The second tongue 63 has a straight shaft section 67, which extends upwards away from the contact spring 1, and a bent section 69. The bent section 69 is bent out of the plane E of the contact spring 1 by more than 90°, such that an angle β between the bent section 69 and the shaft section 67 is less than 90°; in the shown embodiment, the angle β is 70°±5°. This pronounced bend is therefore advantageous because an end section 71 of the bent section 69 does not protrude further upwards than a highest point 73 of the support surface 59, and consequently, damage to a cradle or tilting therewith can be avoided as a result.

The support surface 59, as shown in FIG. 1B, is laterally spaced apart from the hook 27 in the longitudinal direction L. A recess 75, as shown in FIG. 1A, is disposed between the support surface 59 and the hook 27. A second recess 77 is disposed on the second shoulder 57, at which there is no support surface in the shown embodiment. In other embodiments, alternatively or in addition to the support surface 59, the second shoulder 57 can have a support surface. The recesses 75 and 77 protrude downwards into the switching leg 5. The recesses 75 and 77 can receive parts of a cradle, as described in greater detail below, without contact between the cradle and the contact spring 1.

Figure 2:
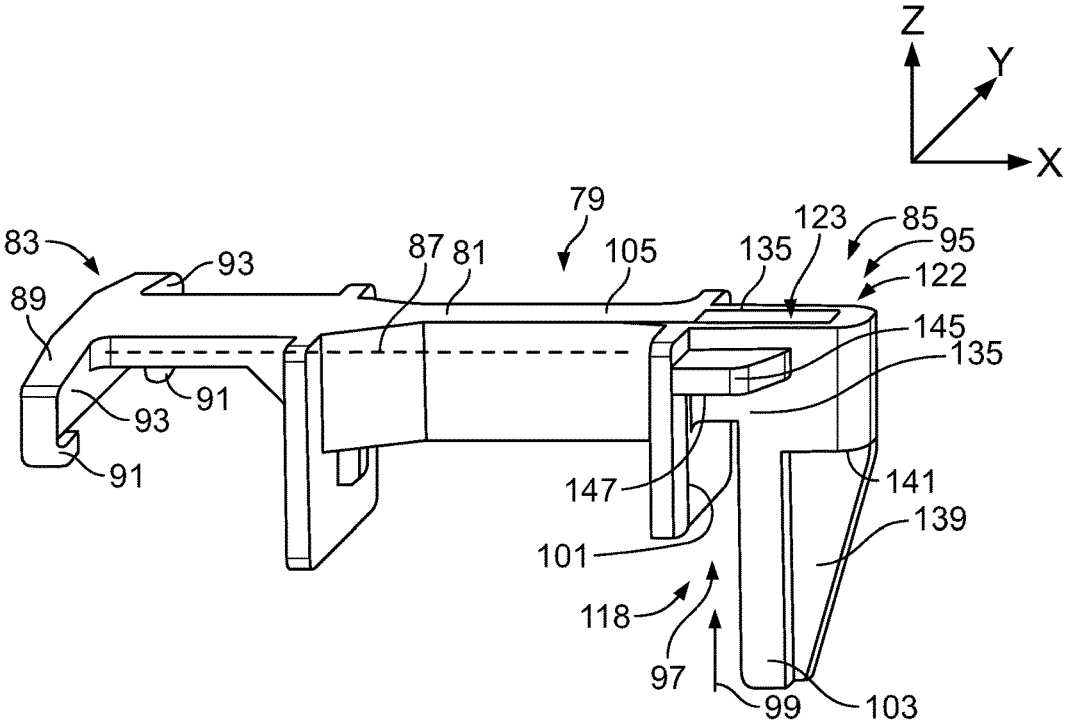
FIG. 2 is a perspective view of a cradle according to the invention.
Figure 3:
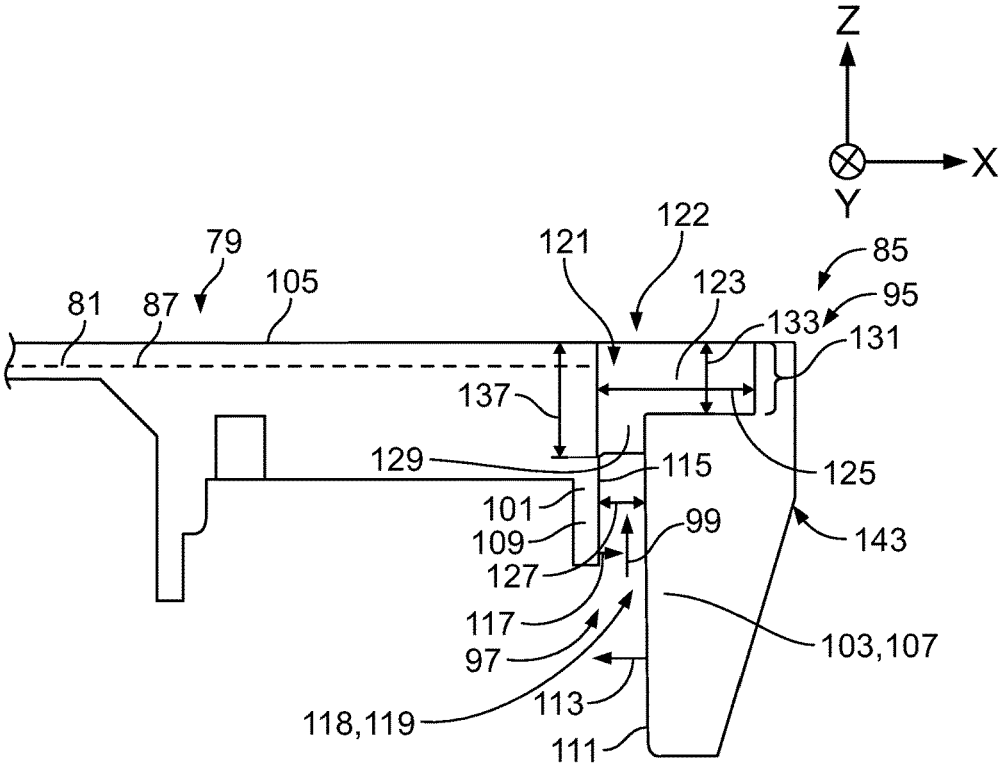
FIG. 3 is a sectional view of the cradle of FIG. 2.

A cradle 79 according to the invention is shown in FIGS. 2 and 3. The cradle 79 has a cradle body 81 which has an overall elongated shape. The cradle 79 has an armature-side end 83 and a spring-side end 85. The body 81 extends in a substantially elongated manner along a connecting line 87 between the armature-side end 83 and the spring-side end 85. In FIGS. 2 and 3, the connecting line 87 is shown parallel to the X-direction.

The cradle 79, as shown in FIGS. 2 and 3, has a substantially continuous straight upper side 105. The upper side 105 does not have upwardly protruding elements, and consequently, the cradle 79 can slide along a surface in the direction of the connecting line 87. For example, the cradle 79 can slide along a housing wall of an electrical switch, in order to be guided by it.

The cradle 79, as shown in FIGS. 2 and 3, has an armature connector 89 at its armature-side end 83. The armature connector 89 is configured such that, when the cradle 79 is mounted perpendicular to the connecting line 87, it can be connected to an armature. The armature connector 89 has hook-like projections 91 for connection to an armature. An armature can engage in the hook-like projections 91 in order to pull the cradle 79 at its armature-side end 83 along the connecting line 87. The armature connector 89 has stop surfaces 93 for an armature.

The cradle 79 has a contact attachment 95 for the contact spring 1 at its spring-side end 85. Alternatively, the cradle 79 can also have several contact attachments 95 for the simultaneous actuation of several contact springs 1; several contact attachments 95 can, for example, be arranged beside one another transverse to the connecting line 87 and/or behind one another along the connecting line 87. The cradle 79 is integrally formed with the armature connector 89 and the contact attachment 95, such as in an injection molding process from an insulative material such as plastic.

The contact attachment 95, as shown in FIGS. 2 and 3, has a contact spring shaft 97. The contact spring shaft 97 extends perpendicular to the connecting line 87 and defines an insertion direction 99 parallel to the Z-direction. The contact spring shaft 97 has an insertion end 118 and a catching end 122 opposite to the insertion end 118. The insertion end 118 is disposed at the end of the contact spring shaft 97 facing away from the upper side 105, while the catching end 122 is flush with the upper side 105.

The contact spring shaft 97, as shown in FIGS. 2 and 3, is delimited in the direction of the connecting line 87 by two walls 101, 103 that project downwards. The walls 101, 103 are disposed behind one another along the connecting line 87. The wall 103 situated further away from the armature-side end 83 forms a pulling element 107 of the cradle 79 for the contact spring 1. The wall 101 arranged between the pulling element 107 and the armature-side end 83 forms an abutting element 109 for the contact spring 1.

If the cradle 79 described is used for an electrical switch in which an armature pulls the cradle 79 in the direction of the armature-side end 83 when a magnetic force comes to bear, the pulling element 107 pulls the contact spring 1 in the same direction. When the magnetic drive force on the armature abates, the contact spring 1 moves the cradle 79 forwards, or in the direction of the spring-side end 85, through a spring restoring force onto the pulling element 107 or onto the wall 103 along the connecting line 87. In an electrical switch in which a magnetic drive force moves the cradle in the direction of the armature-side end 83, the wall 103 extends further downwards than the wall 101. As a result, the wall 103 can represent an extensive pulling element 107.

By contrast, if the cradle 79 is used in an electrical switch in which the cradle 79 is moved in the direction of the spring-side end 85 through the action of a magnetic force on the armature, the contact spring 1 moves through the abutting element 109 and thus can trigger a switching process. After the action of a magnetic force ceases, the contact spring 1 exerts a pressure onto the abutting element 109 again through its restoring force and moves the cradle 79 in the direction of the armature-side end 83.

For a transmission of force between the wall 103 and the contact spring 1, the wall 103 forms a stop surface 111, as shown in FIGS. 2 and 3. In this case, a normal direction 113 of the stop surface 111 parallel to the connecting line 87 points in the direction of the armature-side end 83. The stop surface 111 delimits the contact spring shaft 97 in the direction of the spring-side end 85. The wall 101 forms a second stop surface 115. The second stop surface 115 extends substantially parallel to the stop surface 111. A normal direction 117 of the second stop surface 115 points parallel to the connecting line 87 in the direction of the spring-side end 85.

At the insertion end 118, an insertion aperture 119 extends between the walls 101, 103. The insertion aperture 119 receives an attaching mechanism of the contact spring 1 into the contact spring shaft 97. To facilitate the insertion of an attaching mechanism, the contact spring shaft 97 is widened in the region of the insertion aperture 119. At a catching end 122 opposite the insertion end 119, the contact spring shaft 97 has a receiving chamber 123. The receiving chamber 123 receives the attaching mechanism of the contact spring 1, such as a snap-fit hook of the contact spring 1. The snap-fit hook, as described in greater detail below, can be received in the receiving chamber 123 in a relaxed state when it has been elastically compressed when passing through the contact spring shaft 97.

A depth 125 of the receiving chamber 123, as shown in FIG. 3, is greater than a depth 127 of the contact spring shaft 97. The depths 125, 127 are each defined parallel to the connecting line 87. In order to form the receiving chamber 123, the wall 103 is relocated in the region of the receiving chamber 123 from the inner space 129 of the contact spring shaft 97. In this case, an upper section 131 of the wall 103 is displaced from the inner space 129 in the direction of the armature-side end 83. The upper section 131 defines a height 133 of the receiving chamber 123.

In the region of the receiving chamber 123, the contact spring shaft 97 is delimited by lateral delimiting ridges 135, as shown in FIG. 2. The lateral delimiting ridges 135 extend downwards deeper than the receiving chamber 123; a height 137 of the delimiting ridges 135 is greater than the height 133 of the receiving chamber 123, as shown in FIG. 3. Both the delimiting ridges 135 and the receiving chamber 123 are flush with the upper side 105 of the cradle 79.

In order to increase the stability of the wall 103, the wall 103 has a stiffening rib 139, as shown in FIG. 2. The stiffening rib 139 extends perpendicular to the stop surface 111 and away from the wall 103. The stiffening rib 139 extends in the direction of the spring-side end 85 and is supported on a floor 141 of the receiving chamber 123. The stiffening rib 139 is integrally formed with the wall 103 and the floor 141 of the receiving chamber 123. An upper end 143 of the stiffening rib 39 is flush with a front end of the cradle 79 at the height of the receiving chamber 123.

In the region of the receiving chamber 123, the cradle 79 has the at least one support wall 145, as shown in FIG. 2. The support wall 145 extends laterally and forwards from the wall 101. The support wall 145 has a support surface 147 facing downwards. The support surface 147 can be used to place the cradle 79 on the contact spring 1.

Figure 4:
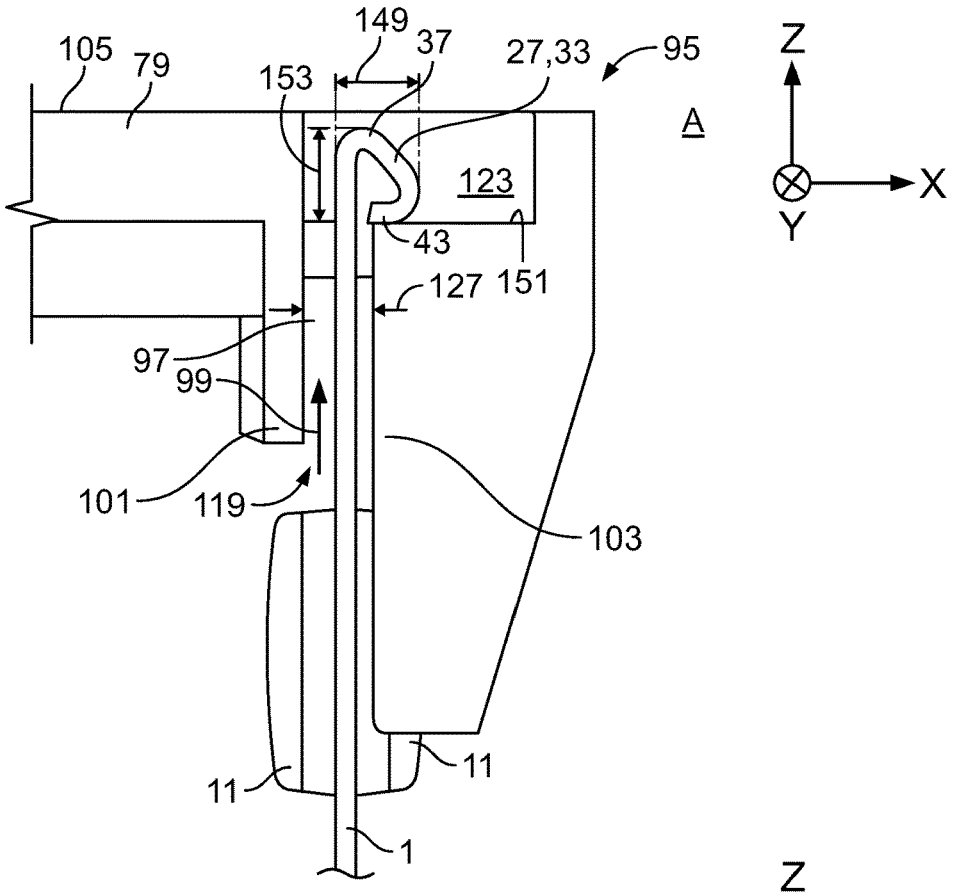
FIG. 4 is a sectional view of the contact spring of FIG. 1A and the cradle of FIG. 2 in a mounted position.
Figure 5:
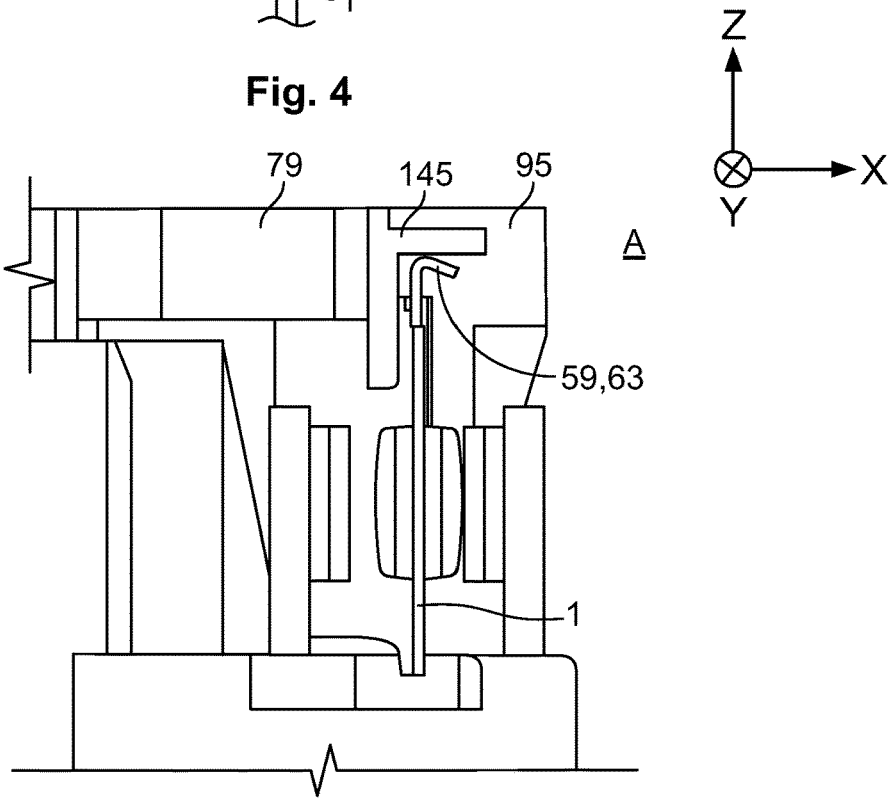
FIG. 5 is a side view of the contact spring of FIG. 1A and the cradle of FIG. 2 in the mounted position.

An assembly of the contact spring 1 with the cradle 79 will now be described with reference to FIGS. 4 and 5. In FIGS. 4 and 5, only a region around the contact spring shaft 97 and the hook 27 is shown. The cradle 79 and the contact spring 1 are part of an electrical switch having a cradle relay. The electrical switch, in other embodiments, can also have several cradles 79 and/or contact springs 1 according to the invention.

The contact spring 1 and the cradle 79 are shown in FIG. 4 in a mounted state A in which the hook 27 sits in the receiving chamber 123. To achieve the mounted state A, the hook 27 is inserted along the insertion direction 99 into the contact spring shaft 97. Due to the configuration of contact spring 1 and the cradle 79, the insertion through a straight-line movement of the cradle 79 onto the hook 27 is possible; pivoting or tipping of the cradle 79, or rather a threading movement of the cradle 79, is not required.

The hook 27 penetrates through the insertion aperture 119 into the contact spring shaft 97. A depth 149 of the hook 27, as shown in FIG. 4, is greater than the depth 127 of the contact spring shaft 97. As a result, the hook 27 is elastically compressed in the contact spring shaft 97 during insertion. In addition or alternatively, in other embodiments, at least one of the two walls 101, 103 is elastic, such that they are deflected elastically from the hook 27 to the outside of the contact spring shaft 97. As soon as the hook 27 is arranged in the receiving chamber 123, it can relax again and assume its depth 149.

In the mounted state A shown in FIG. 4, the hook 27 is then secured, by the end section 43 of the first tongue 33 which runs substantially parallel to a lower inner floor 151 of the receiving chamber 123, against a retreat into the contact spring shaft 97. An outer spacing 153 between the end section 43 of the first tongue 33 and the first bend 37 is smaller than the height 133 of the receiving chamber. As a result, the hook 27, in the mounted state A, does not project over the upper side 105 of the cradle 79. The wall 103 extends up to the height of the contacts 11. The wall 103 is laterally spaced apart from the contacts 11, such that it does not directly bear upon one of the contacts 11.

In the mounted state A, as shown in FIG. 5, the support wall 145 bears on the support surface 59 of the contact spring 1. Since the support surface 59 of the contact spring 1 is formed from a bent material tongue 63, with the material tongue 63 being bent back onto the rest of the contact spring 1, the support wall 145 bears on the highest point 73 of the material tongue 63 and thus on a rounded region. As a result, it is possible to prevent a material abrasion from being generated at the point of contact between the support wall 145 and the support surface 59 when the cradle 79 moves relative to the contact spring 1. In the mounted state A, the lateral delimiting ridges 135 protrude into the recesses 75, 77, such that material abrasion between the cradle 79 and contact spring 1 can also be avoided at these points.

Figure 6:
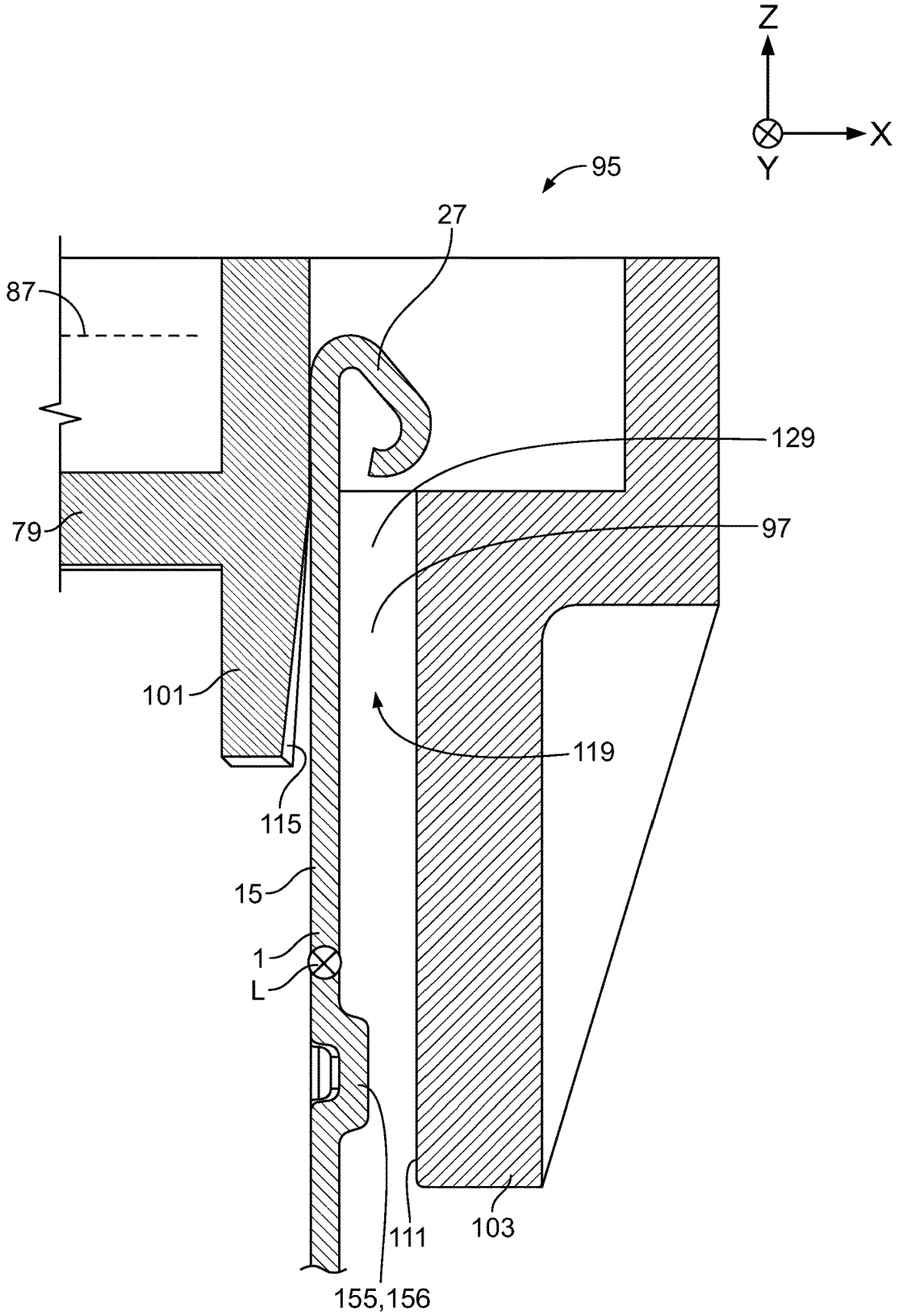
FIG. 6 is a sectional view of a contact spring and a cradle according to another embodiment of the invention.

FIG. 6 shows a contact spring 1 having a hook 27 inserted through a cradle 79 in the region of the contact spring shaft 97 according to another embodiment of the invention. Only differences from the embodiment shown in FIGS. 1-5 will be described in greater detail.

The contact spring 1, as shown in FIG. 6, has a stiffening element 155. The stiffening element 155 is formed as a seam 156 and runs in an elongated manner perpendicular to the connecting line 87 and parallel to the longitudinal direction L of the elongate subcomponent 15 of the contact spring 1.

The second embodiment of the cradle 79 has a wall 103 which extends downwards over the stiffening element 155. As a result, when the cradle 79 moves in the direction of the armature-side end 83, the stop surface 111 strikes the stiffening element 155 and moves the contact spring 1. The stiffening element 155 prevents the contact spring from bending through in the region of the abutting wall 103 and at the same time uniformly distributes the force of the contact spring 1 onto this. Alternatively, or as in the first embodiment of the contact spring 1 described with reference to FIGS. 1A and 1B, a slight bending-through of the contact spring 1 when a force takes effect through the wall 103 can also be desired in order to facilitate a detaching of the contacts 11 from counter-contacts.

The wall 101 is formed such that the second stop surface 115 extends in a sloping manner away from the inner space 129 of the contact spring shaft 97. As a result, the insertion aperture 119 widens downwardly, and an insertion of the hook 27 is facilitated.

What is claimed is:

1. A contact spring for a cradle relay of an electrical switch, comprising:

a switching leg having a contact; and a hook extending from the switching leg and having a first tongue bent back toward the switching leg, the first tongue is bent more than once and is bent back on itself in an end section of the first tongue.

2. The contact spring of claim 1, wherein the hook is an elastically deformable snap-fit hook.

3. The contact spring of claim 1, wherein the hook is integrally formed with the switching leg.

4. The contact spring of claim 1, wherein the end section of the first tongue is spaced apart from the switching leg.

5. The contact spring of claim 1, further comprising a shoulder disposed at a base of the hook.

6. The contact spring of claim 5, wherein the shoulder has a support surface.

7. The contact spring of claim 6, wherein the support surface is formed by a bent second tongue extending from the switching leg.

8. The contact spring of claim 7, wherein an overall width of the second tongue in a direction of a material thickness of the switching leg is greater than the material thickness of the switching leg.

9. The contact spring of claim 8, wherein the second tongue is spaced laterally from the hook.

10. The contact spring of claim 1, wherein the hook is disposed on a long side of the switching leg.

11. The contact spring of claim 1, further comprising a stiffening element disposed on the switching leg.

12. The contact spring of claim 11, wherein the stiffening element is a seam extending parallel to a longitudinal direction of the switching leg.

13. A contact spring for a cradle relay of an electrical switch, comprising:

a switching leg having a contact;

a hook extending from the switching leg and having a first tongue bent back toward the switching leg; and a shoulder disposed at a base of the hook.

14. The contact spring of claim 13, wherein the shoulder has a support surface.

15. The contact spring of claim 14, wherein the support surface is formed by a bent second tongue extending from the switching leg.

16. The contact spring of claim 15, wherein an overall width of the second tongue in a direction of a material thickness of the switching leg is greater than the material thickness of the switching leg.

17. The contact spring of claim 16, wherein the second tongue is spaced laterally from the hook.

* * * * *